United States Patent [19]

Saly

[11] Patent Number: 5,063,862

[45] Date of Patent: Nov. 12, 1991

[54] SOLID WASTE RECLAMATION AND PROCESSING METHOD

[75] Inventor: Udi E. Saly, Newton Center, Mass.

[73] Assignee: Flexible Environmental Systems, Inc., Boston, Mass.

[21] Appl. No.: 532,194

[22] Filed: Jun. 1, 1990

[51] Int. Cl.[5] ..... F23G 5/00

[52] U.S. Cl. ..... 110/346; 110/233; 110/241

[58] Field of Search ..... 110/346, 233, 235, 241, 110/240

[56] References Cited

U.S. PATENT DOCUMENTS 4,750,437 6/1988 Rouse ..... 110/346

OTHER PUBLICATIONS

*The Boston Sunday Globe* "Firm Proposes Burning City's Waste at Sea", David Warsh, Jun. 3, 1990.

*The Boston Sunday Globe,* Environment Watch, "Smoke on the Water", Nick Tate, Jun. 3, 1990.

*Primary Examiner*—Edward G. Favors

*Attorney, Agent, or Firm*—Fish & Richardson

[57] ABSTRACT

Solid waste is loaded onto a reclamation barge or ship in which it is processed into recyclable materials and nonrecyclable waste. Recyclable materials are stored separately in symmetrical holds on either side of a central incoming hold. Nonrecyclable waste is compacted and stored on the reclamation ship and transferred ultimately to an incineration ship which conducts incineration with ash encapsulation at a safe distance offshore.

22 Claims, 5 Drawing Sheets

SOLID WASTE RECLAMATION AND PROCESSING METHOD

FIELD OF THE INVENTION

The invention is related to systems and methods for treating solid waste.

BACKGROUND OF THE INVENTION

As the population of the world continues to increase it is becoming more difficult to safely dispose of the solid waste created by both industry and individuals. Governments are continuously seeking better methods for treating solid waste in order to minimize its impact on our fragile environment. As landfills overflow with waste and leach contaminants into the ground water, there is an increasing need to recycle as many items and materials as possible and to find some alternative for disposing of those items that cannot be recycled.

SUMMARY OF THE INVENTION

The inventions feature systems and methods for reclaiming and treating solid waste (e.g., municipal solid waste) that uses a floating reclamation and processing center in conjunction with a floating incineration vessel where incineration and a novel encapsulation process are performed.

In one aspect, the invention generally features a method of treating solid waste comprising the steps of loading the solid waste onto a first vessel, separating the solid waste into recyclable waste and non-recyclable waste on the first vessel, transferring the non-recyclable waste onto a second vessel, and incinerating the non-recyclable waste on the second vessel. In the preferred embodiment, the second vessel is moved to a safe incineration location (e.g., to a remote ocean site) prior to the step of incinerating.

The reclamation vessel includes a solid waste storage area for receiving the solid waste, the storage area located at approximately the longitudinal center of the vessel, and a plurality of reclamation sites located along the vessel, on both sides of the storage area. The solid waste is transported from the storage area past the reclamation sites and recyclable materials are removed from the solid waste as the waste passes each cite.

The invention also features a method for treating fly ash and ground ash including the steps of mixing the fly ash with a molten material (e.g., plastic) and cooling the mixture to form solid products and mixing the solid products with the ground ash and a second molten material and cooling the mixture to form a second solid product.

DETAILED DESCRIPTION OF THE PREFERRED EMBODIMENTS

Figure 1:
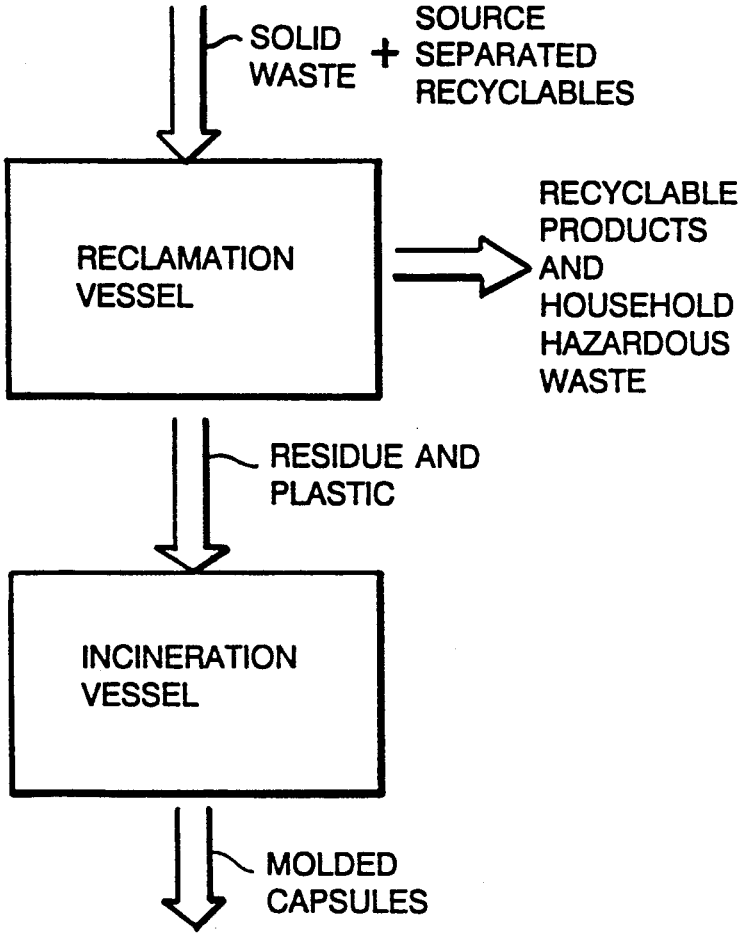
FIG. 1 is an overall block diagram of a system for treating solid waste in accordance with the invention.

Referring to FIG. 1, the overall municipal solid waste ("MSW") treatment system of the invention uses two vessels or ships, a reclamation vessel and an incineration ship. Solid waste in its raw form, and source separated recyclables (from curb-side recycling programs) are delivered to the reclamation vessel by barges or other usual methods of transporting waste. The waste is separated on the reclamation vessel into recyclable materials, such as cardboard, aluminum, steel, glass etc., household hazardous waste (e.g., kerosene), and non-recyclable materials or "waste residue." The systems on board the reclamation vessel also separate plastic materials for use in an encapsulation process, described below. The recyclable materials are processed and readied for further industrial processing, stored on board the reclamation vessel, and every so-often transported from the reclamation vessel by barges etc. and delivered to appropriate distributors. The waste residue and collected plastics are stored on board the reclamation vessel in holds, and are transferred to the incineration vessel, where the waste residue is incinerated at a safe and remote ocean site. The ash generated by the incineration is encapsulated using the plastic materials to produce safe molded capsules that can be used for various purposes, e.g., as rail-road ties. The reclamation and encapsulation methods are described in greater detail below.

Figure 2:
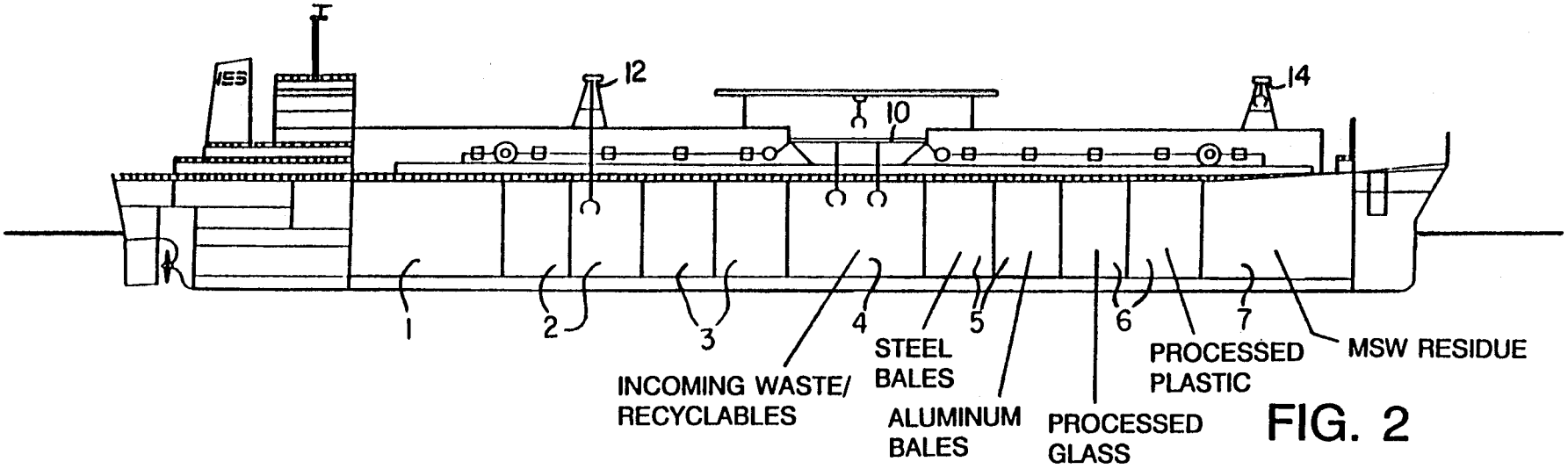
FIG. 2 is a cross-sectional diagram of a reclamation vessel shown in FIG. 1.
Figure 4:
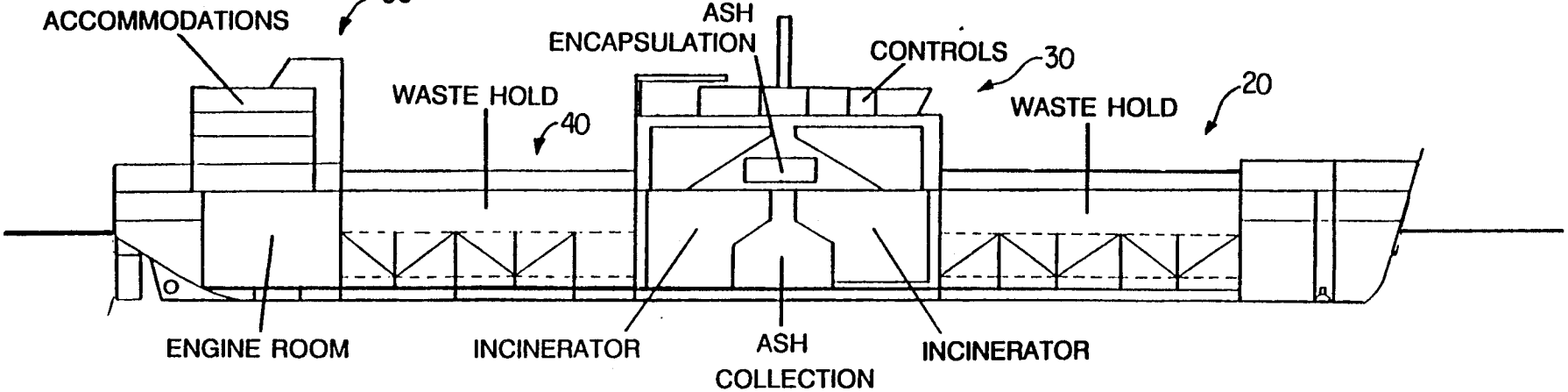
FIG. 4 is a cross-sectional diagram of an incineration vessel shown in FIG. 1.

The reclamation vessel is a floating reclamation and processing center that may either be built from the keel up, or constructed on board a converted bulk carrier, preferably a "Panamax" class bulk carrier. The bulk carrier or "reclamation vessel", shown in FIG. 2, is 660 feet long, and 110 feet wide, with seven holds, numbered 1–7. Holds 2, 3, 5 and 6 are divided to accommodate the variety of materials processed on board the vessel. A central dual grab crane 10 unloads incoming barges. The "raw" solid waste and the source separated "co-mingled" materials are dumped into hold 4, which is partitioned to separate these two distinctive commodities, and from which it is fed into four separation lines that are operated on the upper deck of the vessel. In each of the separation lines, recyclable materials are separated from the waste stream, processed to an industry ready form, and stored in holds 2, 3, 5 and 6. The separation lines each begin at hold 4 and proceed toward holds 1 and 7. This symmetrical arrangement of the separation lines will keep the vessel properly balanced, and the redundant systems allow continuous operation in the event of a failure in one separation line. This design also allows the separation facility to act at capacity with the anticipated change in waste stream composition.

The recyclable materials include cardboard, steel, aluminum, glass and plastic. Cardboard is removed manually at the earliest stage of the process, as the stream of waste is unloaded into the vessel. All cardboard is baled immediately, and stored on board for shipments.

Figure 3:
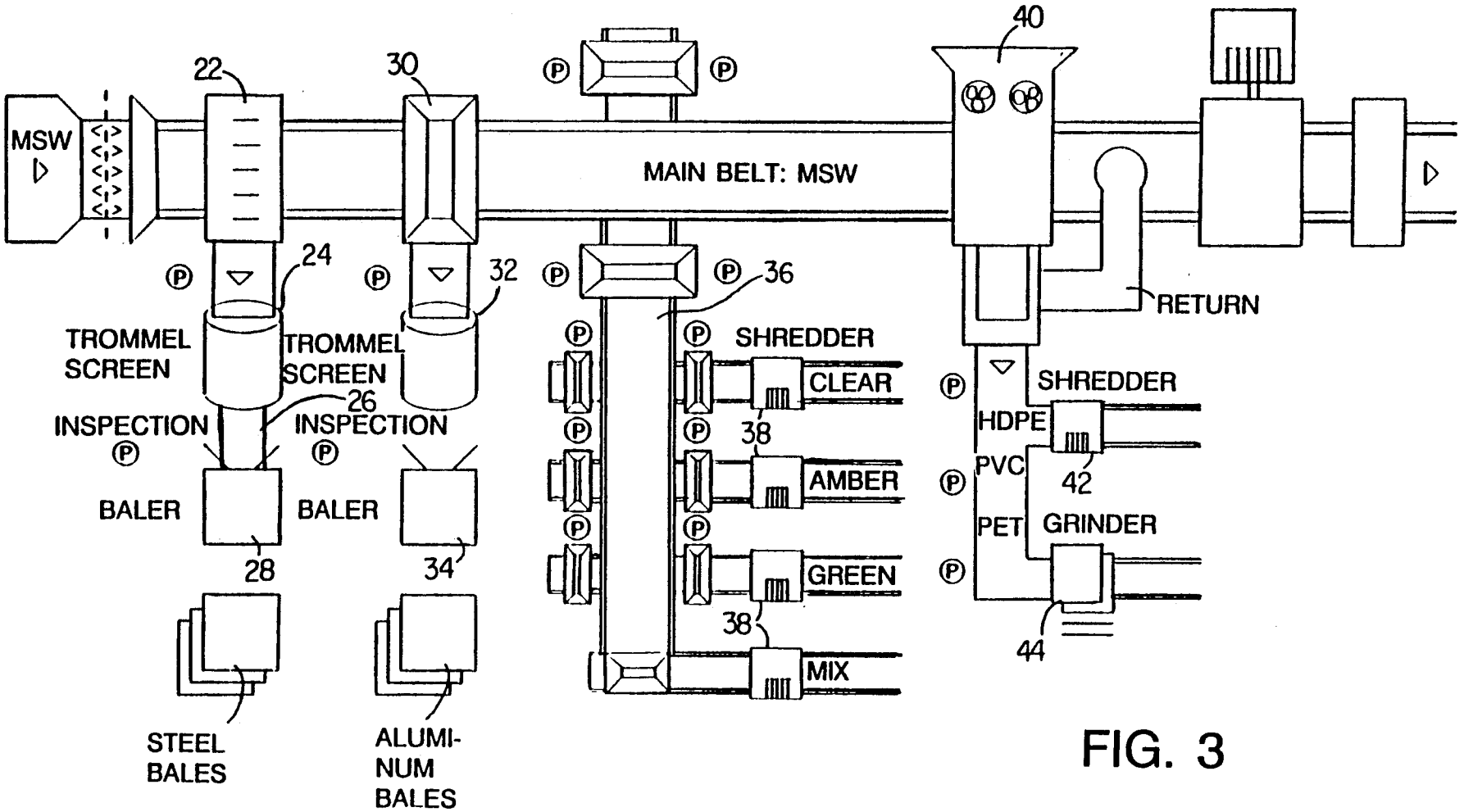
FIG. 3 is a plan view of a separation line that operates on the reclamation vessel shown in FIG. 2.

Referring to FIG. 3, the MSW is loaded onto a moving belt 20, steel, mostly food and beverage cans, is magnetically separated from the waste. A powerful hanging magnet 22 picks up all steel materials. Because other materials are inadvertently picked up with the steel, the material removed by the magnet is conveyed into a screen trammel 24 where all waste materials are separated from the steel. The clean steel then runs over a hazardous waste detection conveyer 26. At this stage all containers suspected of containing potentially hazardous materials such as paint, fuel, motor oil and the like are removed. Following this separation, the clean metal will enter a baler chute 28 where it is baled to the metal recycler's specifications. The baling system is located on the top floor of the "steel" portion of holds 3 and 5. Those holds are structurally designed to support the baling system, and are equipped with pallet lifters to lower the baled steel into the bottom of the holds.

Aluminum is separated from the general waste stream by an eddy current system 30, a system that uses special electrical waves and the properties of aluminum to distinguish and separate aluminum from the other waste. Eddy current systems are commercially available from all major separation systems vendors, including Raytheon Company and Siemens U.S. After the separation, the aluminum passes through a cleaning trammel 32 similar to that for steel described above, and then goes directly into a baling machine 34. There is no need for hazardous waste separation at this stage, since hazardous materials are not normally found in regular aluminum containers. Typically, aluminum containers that do contain hazardous materials will be oversized containers, and will be detected and removed at the trammel level. The aluminum baling system is located on the top floor of the "aluminum" portion of holds 3 and 5. As in the steel portion of these holds, the area is designed for the baling system, and is equipped with pallet lifters to lower the aluminum bales into the bottom of the holds for storage.

Glass is extracted manually, after the steel and aluminum materials have been removed and is placed on a glass conveyor 36. The glass separation line includes color separation to white, (or clear) green, amber and a mixture of other colors. Following separation, glass is crushed in commercially available glass shredders 38, and conveyed via conveyors and dual stage vibrating screens not shown) to silos located in holds 2 and 6.

Plastic is then removed from the waste stream by a standard air classification system 40 and is processed via commercially available standard plastic shredding system 42 and grinding system 44. From these systems it is conveyed into silos mounted in holds 2 and 6, where it is stored for later loading on the incineration vessel and use in an ash encapsulation system, described below.

Referring again to FIG. 2, two bridge cranes 12, 14 unload the recyclable materials that have been removed from the waste stream onto barges for marine transportation to their final destinations. The same cranes are capable of unloading the baled materials onto trucks or rail-cars if the vessel is moored along a pier. Glass is unloaded from the storage silos by means of pneumatic or auger type glass conveying systems. All such cranes and conveying systems are commercially available, and are used in a variety of material handling related operations.

The waste that is left over when all of the recyclable materials have been removed (the "residue") is shredded to a uniform flow and subsequently compacted at the end of the separation lines to pellets or briquettes with a density of approximately 45 lb. per cu. ft. It is then stored in holds 1 and 7, which are equipped with bucket elevator and conveyor unloading systems. The holds are also equipped with carbon air filtration systems, commonly available and installed in most modern waste transfer stations.

The waste residue and plastics are loaded onto a specially designed incineration vessel, shown in FIG. 3, for incineration and ash encapsulation at a designated ocean site. The incineration vessel is 540 feet long, 90 feet in beam and 42 feet deep. It has a full load summer loadline of 29'4". The vessel is comprised of four main compartments: a front waste residue hold 20 which is 120' long and has a 5,000 ton capacity; an incineration, ash processing and vessel control section 30; an aft waste residue hold 40 which also is 120' long and has a 5,000 ton capacity; and an engine room and vessel accommodations section 50.

The incineration vessel is equipped with special covers and air recycling and filtration systems to prevent possible odor emissions while in port. As indicated, such systems are commonly available at modern transfer stations.

Once the incineration vessel is loaded with residue and plastic from the reclamation vessel, it leaves port and sails to its designated offshore incineration site. The incineration process starts only after the vessel reaches its pre-determined incineration starting point. This can be monitored by special safeguards that tie in with a satellite navigation system, releasing an "incinerator switch" that allows starting of the incineration process only after a specific geographic point is reached. This system is based on commercially available satellite navigation systems such as the "Loran" navigation system. These systems record the accurate geographic location of the vessel at all times, and can be set with specific parameters that determine a geographic area where the vessel is allowed to incinerate. Only at those given locations, the system connects the electronic switch that powers the incineration blower fans. Without these fans, incineration cannot take place.

The incineration vessel uses a standard incineration technique. The incinerators are of the traveling stoker grate type, with forced air and sea water cooling of the furnace top. Unlike waste-to-energy facilities, where such incinerators boil water to create steam that generates electricity via steam turbines, there is no boiler operation involved in the offshore incineration operation. The incinerators are refractory brick-lined, and thus can be easily kept at a high temperature by sealing the incineration chamber when the ship is travelling to and from port and during the loading period. The incinerators are pre-heated using fuel oil in order to reach the minimum incineration and combustion temperatures before commencement of the incineration operation.

Waste residue is mechanically loaded from storage holds 20, 40 into a feed hopper. The system includes a combination of widely used waste moving technologies, including walking floor hopper bottoms, a combination walking floor and auger systems, dual belt material elevation systems, and an automatic feed hopper system which is part of the incineration system combustion package.

The waste incineration combustion package includes an automatic measuring feed hopper, a ram waste feeding system, a continuous furnace moving grate system and an ash sifting and unloading system. It is supplied as a complete package by one of many companies in this field, including Detroit Stoker Company, Babcock & Wilcox and others.

Waste residue is automatically fed into the incinerator grate area where it is incinerated.

The incineration process is fanned by high capacity fans that are an integral part of the aforementioned combustion package. At the end of the process the bottom ash is removed from the bottom of the incinerator grate via a shredder (standard waste handling equipment) to the ash holds located under the incinerator foundation in the middle of the incineration ship. Fly ash is collected into separate holds located immediately above the bottom ash collection holds. All ash is dried and cooled at the end of the incineration process prior to its storage in the holds.

All emissions from the process will go through a series of scrubbers identical to those used in land based incineration and via a set of bag houses. Such bag houses are a series of vacuum cleaner like apparatus, and are used in a variety of emission generating industries. They are commonplace in the waste incineration industry. Such emission control apparatus are typically required by the most stringent land based regulations.

Figure 5:
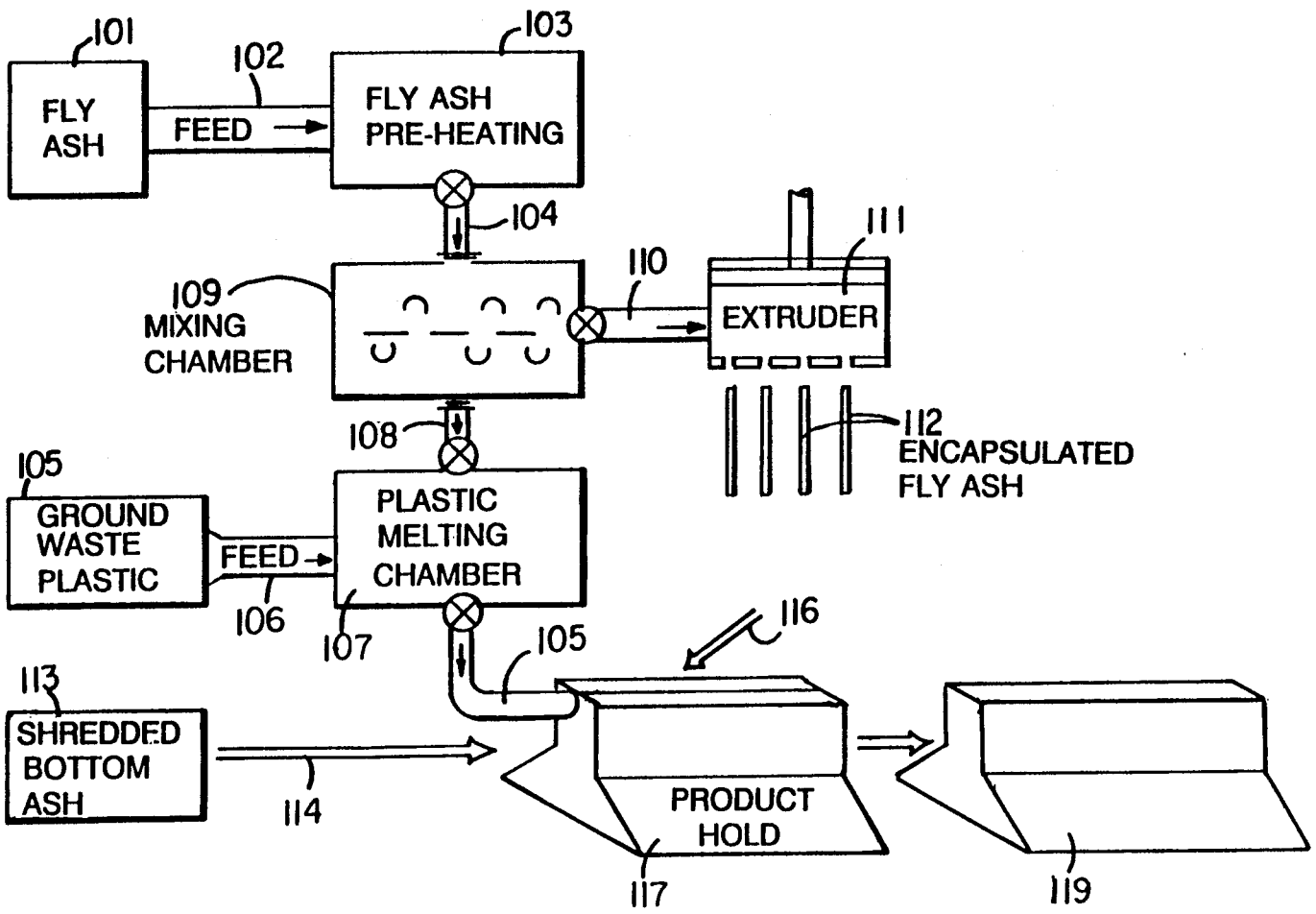
FIG. 5 is a diagram of an encapsulation system performed on the incineration vessel shown in FIG. 3.

The ash is encapsulated on board the vessel in a thermo-chemical process, using the ground plastic reclaimed from the waste as the encapsulating agent. Referring to FIG. 5, the fly-ash is fed directly from the hold 101 by a feeding system 102 into a pre-heating chamber 103. Feeding system 102 may be an auger type or a continuous feed belt conveyer or bucket elevator into a measuring hopper at the infeed of pre-heating chamber 103. Ground plastic is fed by means of auger system 106 from the waste plastic bin 105 into a plastic melting vessel 107. This vessel is either electrically heated or heated by a convection system from the incineration process. The plastic is kept at a constant molten stage by a computerized temperature control system, commonly available in the plastics industry. Molten plastic is pumped via a feed duct 108 into the mixing chamber 109 where it is mixed with the pre-heated fly ash which is fed via an auger system and measure control valve 104 into the same chamber 109.

The molten mixture of fly ash and plastic, at a ratio of 60% ash and 40% plastic is fed into an extruder 111. This extruder and its feeding system is a widely available unit serving the plastics industry. The molten mixture is extruded to form long strands of plastic-encapsulated fly-ash 112 that form a non-directional composite material with a plastic base and fly-ash matrix. Those strands are cooled and cut to specified length to fit into the final product mold discussed below.

Figure 6:
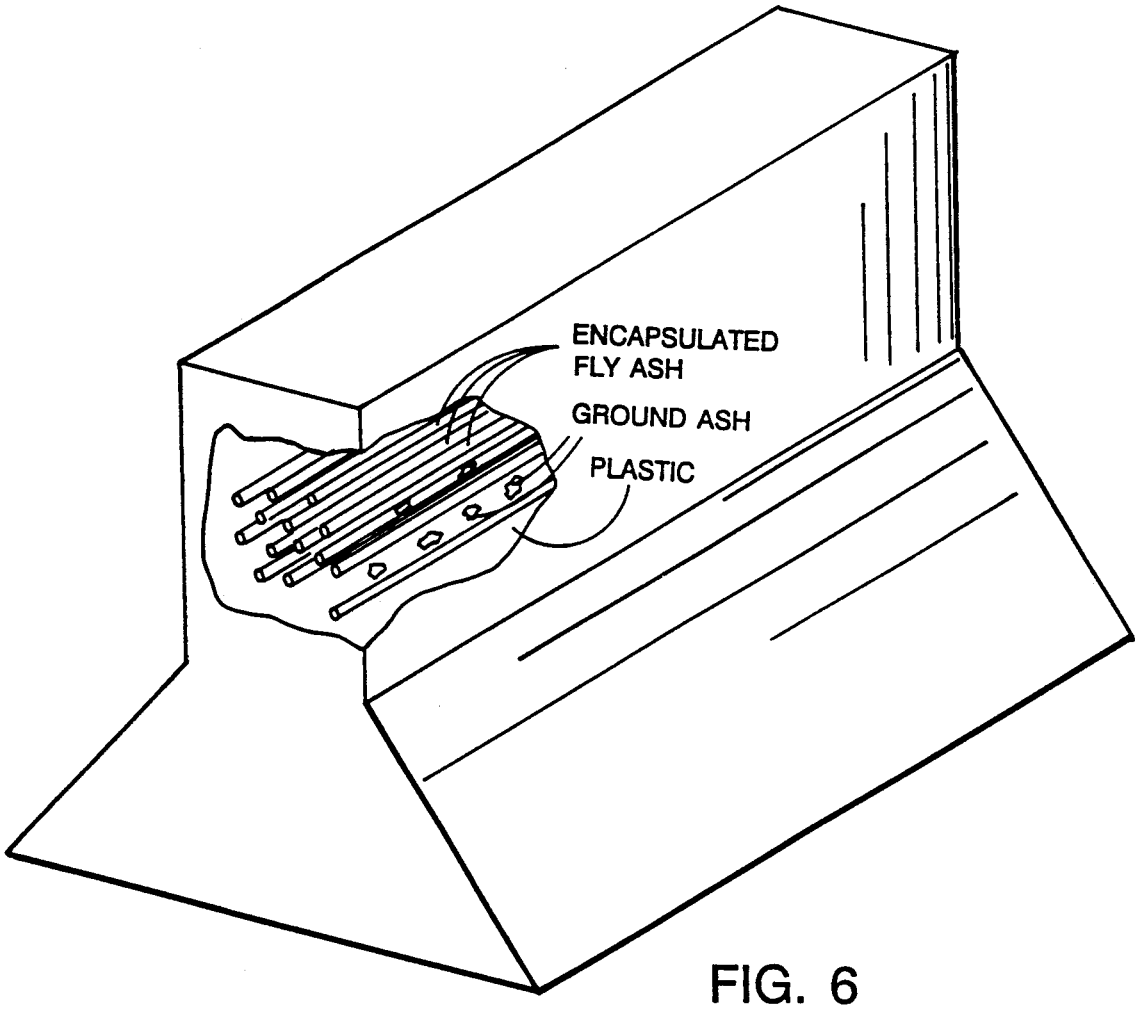
FIG. 6 is a perspective view of an encapsulated product produced by the system illustrated in FIG. 5.

Encapsulated fly-ash strands are placed in a mold 117, to produce the final product of the dual stage encapsulation product. The mold shown is that of a highway divider barrier type (also known as a "Jersey Barrier"). However, the final product may be in the form of railroad ties or other molded composite material. After placing of the strands, shredded bottom ash is poured into the mold from a measuring hopper 113, via a measured auger conveying system 114. The mold, now containing strands of encapsulated fly-ash and shredded bottom ash, is closed and sealed. At this stage, molten plastic is pumped into the closed mold via a measuring conveyor (duct) 115. The mold is cooled to initial solidification temperature, and the finished product 119 is released for final cooling. The final product is shown more clearly in FIG. 6, and includes the encapsulated fly ash, the ground ash and the plastic base.

The final product may require additional strength than that provided by the encapsulated fly-ash strands only. At such instances, it is possible to design the product to include steel, fiberglass or Kevlar type materials. Such materials are product specific, and their use will be determined in accordance with the product design. Strengthening agents like those will be added into the mold prior to the plastic injection.

Due to the high corrosivity of the ash it is preferable to use stainless steel to construct all of the components of the system that will come into direct contact with the ash.

Other embodiments of the inventions described above are within the scope of the appended claims.

We claim:

1. A method of treating solid waste offshore comprising the steps of:

loading said solid waste onto a first oceangoing vessel;

separating said solid waste into recyclable waste and non-recyclable waste on said first vessel;

transferring said non-recyclable waste onto a second oceangoing vessel; and incinerating said non-recyclable waste on said second vessel.

2. The method of claim 1 further comprising the step of moving said second vessel prior to said step of incinerating.

3. The method of claim 1 further comprising the step of removing said recyclable waste from said first vessel.

4. The method of claim 1 wherein said safe incineration location is a predetermined distance from shore.

5. A method of treating municipal solid waste offshore comprising the steps of:

loading said solid waste onto a first oceangoing vessel;

separating said solid waste into recyclable waste and non-recyclable waste on said first vessel;

transferring said non-recyclable waste onto a second oceangoing vessel; and incinerating said non-recyclable waste on said second vessel.

6. The method of claim 5 further comprising the step of moving said second vessel prior to said step of incinerating.

7. The method of claim 5 further comprising the step of removing said recyclable waste from said first vessel.

8. The method of claim 5 wherein said safe incineration location is a predetermined distance from shore.

9. A method of treating municipal and non-hazardous commercial solid waste offshore comprising the steps of:

loading incoming solid waste originating on shore onto a first floating structure;

separating said incoming solid waste into recyclable materials and nonrecyclable waste on board said first structure;

storing said nonrecyclable waste on board said first structure;

transferring said nonrecyclable waste from said first structure onto a second floating structure; and incinerating said nonrecyclable waste on board said second floating structure.

10. The method of claim 9, wherein the step of transferring said nonrecyclable waste includes removing the nonrecyclable waste from said first structure by means of marine-based barge transportation.

11. The method of claim 9, further comprising removing said recyclable materials from said first structure by means of marine-based barge transportation.

12. The method of claim 9, further comprising the step of moving said second structure to a remote ocean location a predetermined distance offshore prior to said step of incinerating.

13. The method of claim 9, further comprising the step of compacting said nonrecyclable waste on board said first structure prior to transferring it to said second structure.

14. The method of claim 9, wherein the step of loading incoming solid waste includes transferring said waste from the shore to said first structure by means of marine-based barge transportation.

15. A method of treating municipal and non-hazardous commercial solid waste offshore comprising the steps of:

loading incoming solid waste originating on shore onto a plurality of oceangoing reclamation vessels;

separating said incoming solid waste into recyclable materials and nonrecyclable waste on board each of said reclamation vessels;

storing said nonrecyclable waste on board each of said reclamation vessels;

transferring said nonrecyclable waste from said reclamation vessels onto a single oceangoing incineration vessel; and incinerating said nonrecyclable waste on board said incineration vessel.

16. The method of claim 15, further comprising the step of moving said second structure to a remote ocean location a predetermined distance offshore prior to said step of incinerating.

17. The method of claim 15, further comprising the step of compacting said nonrecyclable waste on board said reclamation vessels prior to transferring it to said second structure.

18. A method of treating municipal and non-hazardous commercial solid waste offshore comprising the steps of:

transferring incoming solid waste originating on shore onto at least one floating reclamation vessel by means of marine-based barge transportation;

separating said incoming solid waste into recyclable materials and nonrecyclable waste on board said reclamation vessel;

separately storing said recyclable materials and nonrecyclable waste on board said reclamation vessel;

transferring said nonrecyclable waste from said reclamation vessel by means of marine-based barge transportation onto a floating incineration vessel at a remote ocean location a safe distance offshore; and incinerating said nonrecyclable waste on board said second floating structure at said remote ocean location.

19. The method of claim 18, further comprising removing said recyclable materials stored on board said reclamation vessel by means of marine-based barge transportation.

20. The method of claim 18, further comprising the step of compacting said nonrecyclable waste on board said reclamation vessels prior to transferring it to said second structure.

21. A method of treating municipal and non-hazardous commercial solid waste offshore comprising the steps of:

transferring incoming solid waste originating on shore onto at least one floating reclamation vessel by means of marine-based barge transportation;

separating said incoming solid waste into recyclable materials and nonrecyclable waste on board said reclamation vessel;

separately storing said recyclable materials and nonrecyclable waste on board said reclamation vessel;

transferring said nonrecyclable waste from said reclamation vessel onto an oceangoing incineration vessel;

moving said incineration vessel to a remote ocean location a safe distance offshore;

incinerating said nonrecyclable waste on board said second floating structure at said remote ocean; and removing said recyclable materials store don board said reclamation vessel by means of marine-based barge transportation.

22. The method of claim 21, further comprising the step of compacting said nonrecyclable waste on board said reclamation vessels prior to transferring it to said second structure.

* * * * *

UNITED STATES PATENT AND TRADEMARK OFFICE

CERTIFICATE OF CORRECTION

PATENT NO. : 5,063,862

DATED : 11/12/91

INVENTOR(S) : Udi E. Saly et al.

It is certified that error appears in the above-identified patent and that said Letters Patent is hereby corrected as shown below:

On the title page, item [75],

At "Inventor", "Udi E. Saly, Newton Center, Mass.", should be --Udi E. Saly, Newton Center; Brent Dibner, Chestnut Hill, both of Mass.--.

On the title page, item [56],

In "Other Publications", second reference, "The Boston Sunday Globe" should be --Boston Sunday Herald--.

Column 8, line 37, "store don" should be --stored on--.

Signed and Sealed this

Second Day of November, 1993

Attest:

Attesting Officer

BRUCE LEHMAN

Commissioner of Patents and Trademarks